US006447257B2

(12) United States Patent
Orschell

(10) Patent No.: US 6,447,257 B2
(45) Date of Patent: Sep. 10, 2002

(54) AIR COMPRESSOR ASSEMBLY WITH VIBRATION DAMPING STRUCTURE

(75) Inventor: Michael Orschell, Brookville, IN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 35 days.

(21) Appl. No.: 09/735,021

(22) Filed: Dec. 12, 2000

Related U.S. Application Data

(60) Continuation-in-part of application No. 09/708,833, filed on Nov. 8, 2000, which is a division of application No. 09/619,447, filed on Jul. 19, 2000.

(51) Int. Cl.[7] ..... F04B 23/14

(52) U.S. Cl. ..... 417/201; 417/366; 417/423.15; 417/368; 417/415

(58) Field of Search ..... 417/201, 366, 417/423.15, 415, 368

(56) References Cited

U.S. PATENT DOCUMENTS 4,836,755 A * 6/1989 Nitsche et al. ..... 417/368
5,584,675 A * 12/1996 Steurer et al. ..... 417/372
6,056,521 A * 5/2000 Leu et al. ..... 417/423.14

OTHER PUBLICATIONS http://www.vibrasystems.com/prod_03.htm (Oct. 1998).*

* cited by examiner

*Primary Examiner*—Charles G. Freay
*Assistant Examiner*—William Rodriguez
(74) *Attorney, Agent, or Firm*—Jones, Day, Reavis & Pogue

(57) ABSTRACT

An apparatus includes a tank configured to contain air at an elevated pressure, an air compressor which is operative to supply compressed air for storage in the tank, and a base structure which supports the compressor on the tank. A mounting boss projects from the compressor into an opening in the base structure. A vibration damping structure is interposed between the mounting boss and the base structure within the opening.

8 Claims, 6 Drawing Sheets

AIR COMPRESSOR ASSEMBLY WITH VIBRATION DAMPING STRUCTURE

This application is a continuation-in-part of U.S. patent application Ser. No. 09/708,833, filed Nov. 8, 2000, entitled "Air Compressor Assembly with Vibration Damping Structure," which is a divisional of U.S. patent application Ser. No. 09/619,447 filed Jul. 19, 2000, entitled "Air Compressor Assembly with Dual Cooling Fans".

FIELD OF THE INVENTION

The present invention relates to an air compressor, and particularly relates to an air compressor that is mounted on a tank.

BACKGROUND OF THE INVENTION

An air compressor may be used to provide a hand-held tool with pneumatic power. The compressor is part of an apparatus that further includes a motor for driving the compressor and a tank for storing compressed air. A drive assembly operatively interconnects the motor with the compressor, and is mounted on the tank with the motor and the compressor. The drive assembly may include a pulley, a flywheel, and a linkage structure that cooperate to reciprocate a piston within the compressor upon rotation of an output shaft at the motor. The reciprocating piston pumps compressed air into the tank. A pneumatic power hose extends from the tank to the pneumatically powered tool. In some cases the tank is provided with wheels and a handle so that the entire apparatus is portable.

SUMMARY OF THE INVENTION

In accordance with the present invention, an apparatus includes a tank, a compressor and a base structure. The tank is configured to contain air at an elevated pressure. The compressor is operative to supply compressed air for storage in the tank, and the base structure supports the compressor on the tank. A mounting boss projects from the compressor into an opening in the base structure. A vibration damping structure is interposed between the mounting boss and the base structure within the opening.

In a preferred embodiment of the invention, the opening in the base structure has a major portion and a minor portion. The mounting boss has a longitudinal axis and a radially projecting flange. The boss is movable longitudinally into the major portion of the opening, and is further movable transversely from the major portion of the opening to an installed position in the minor portion of the opening.

The vibration damping structure in the preferred embodiment is a one piece elastomeric ring with a tubular central portion. First and second flange portions of the ring project radially from opposite ends of the tubular central portion. The ring is receivable over the boss and is movable to the installed position with the boss. The tubular central portion of the ring then extends through the opening. The first flange portion of the ring is engaged axially between the compressor and the base structure, and the second flange portion of the ring is engaged axially between the base structure and the flange on the boss.

DESCRIPTION OF A PREFERRED EMBODIMENT

Figure 1:
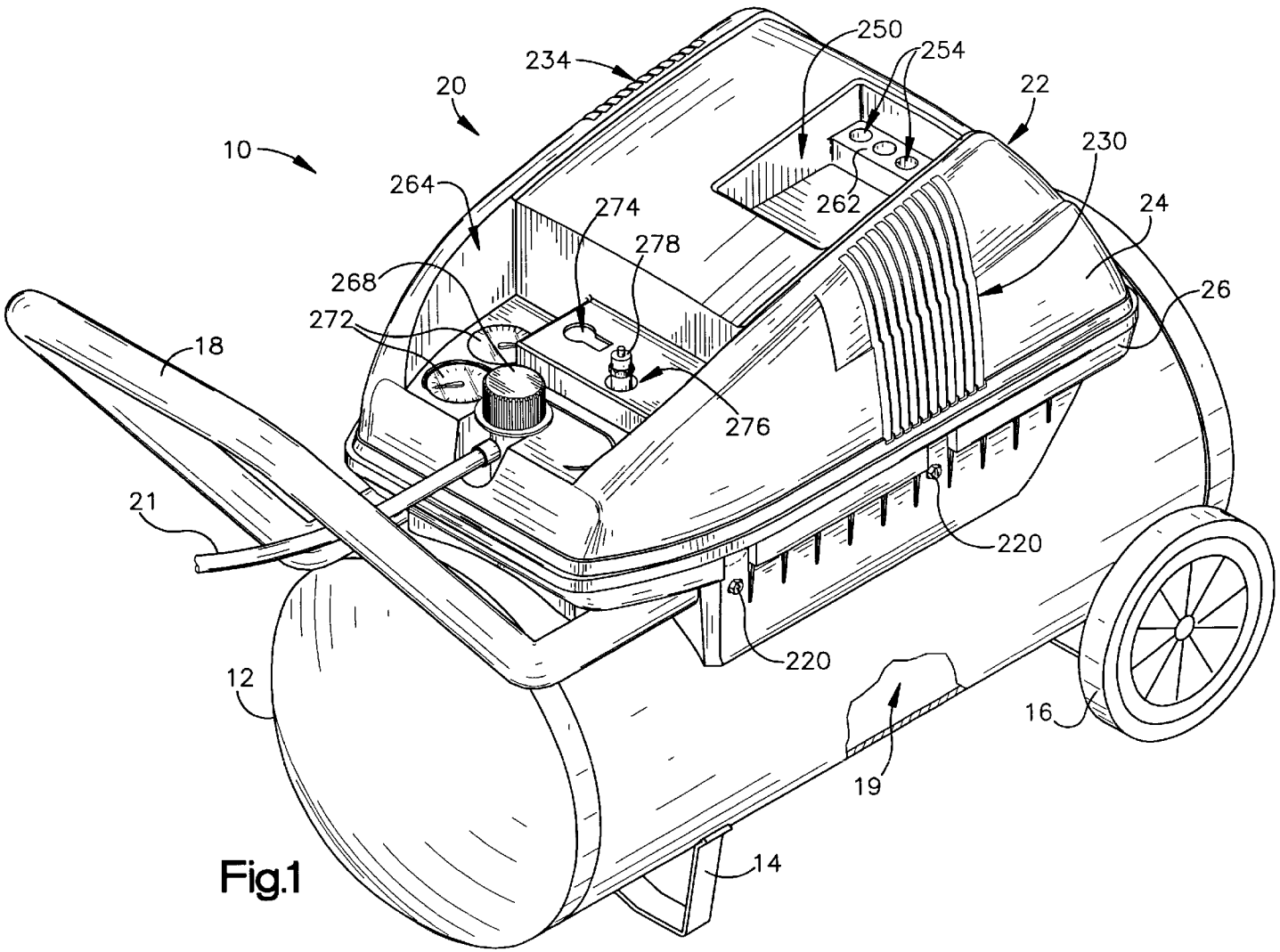
FIG. 1 is an isometric view of an apparatus comprising a preferred embodiment of the present invention.

An apparatus 10 comprising a preferred embodiment of the present invention is shown in FIG. 1. The apparatus 10 includes a tank 12 with a stand 14, a pair of wheels 16, and a handle bar 18. The tank 12 defines a storage chamber 19 containing air at an elevated pressure. A compressor assembly 20 is mounted on the tank 12. The compressor assembly 20 is constructed in accordance with the invention, and operates to supply the storage chamber 19 with compressed air. An outlet hose 21 extends from the compressor assembly 20 to a pneumatically powered tool (not shown) such a hand-held nail gun, impact wrench, or the like.

Figure 2:
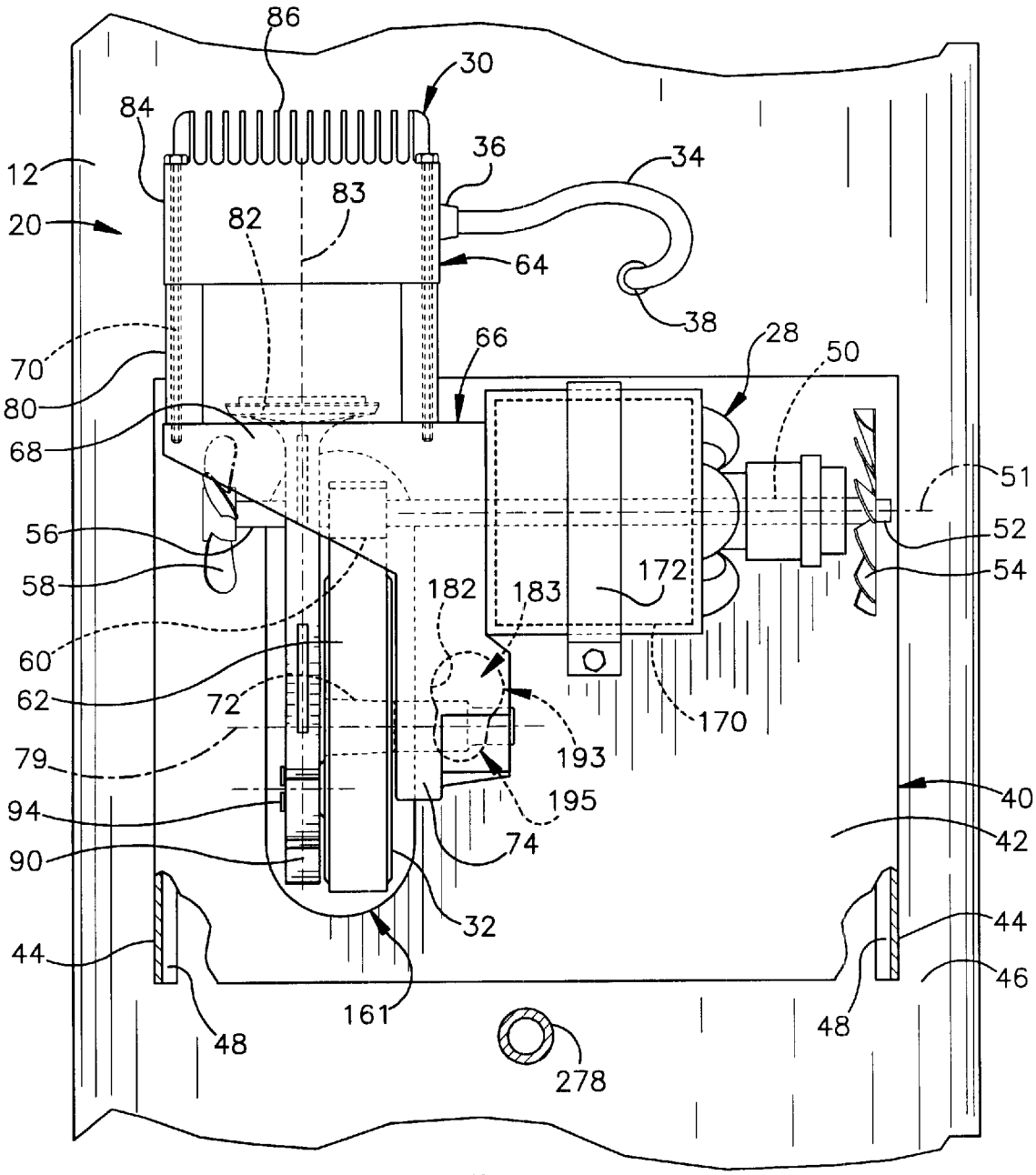
FIG. 2 is a partial top view of the apparatus of FIG. 1, with certain parts omitted for clarity of illustration.

As shown in FIG. 1, the compressor assembly 20 includes a shroud 22 with upper and lower sections 24 and 26. The shroud 22 covers the parts of the compressor assembly 20 that are shown in FIG. 2. These include a motor 28 and a compressor 30. A flywheel 32 is included as part of a drive assembly between the motor 28 and the compressor 30. When the compressor 30 is driven by the motor 28, a pneumatic supply line 34 conveys compressed air from an outlet port 36 on the compressor 30 to an inlet port 38 on the tank 12.

A base structure 40 supports the motor 28 and the compressor 30 on the tank 12. The base structure 40 in the preferred embodiment of the invention is a one-piece metal part defining a flat, rectangular platform 42 with a pair of legs 44. The legs 44 are edge portions of the base structure 40 and project downward from the platform 42 to the cylindrical side wall 46 of the tank. A lower section 48 of each leg 44 extends radially into abutment with the side wall 46 and is welded to the side wall 46.

The motor 28 has an output shaft 50 with a longitudinal central axis 51. A first end portion 52 of the output shaft 50 projects a short distance from the motor 28 at one side of the compressor assembly 20. A first cooling fan 54 is mounted on the first end portion 52 of the output shaft 50. A second end portion 56 of the output shaft 50 projects oppositely from the motor 28 and is substantially longer than the first end portion 52. A second cooling fan 58 is mounted on the second end portion 56 of the output shaft 50. Also mounted on the second end portion 56 is a pulley 60 for a drive belt 62 that transmits torque from the output shaft 50 to the flywheel 32.

The compressor 30 has distinct parts defining a housing 64 and a bracket 66. The housing 64 a generally rectangular block-like structure, and is mounted on a rectangular end portion 68 of the bracket 66 by fasteners 70 at the four corners of the housing 64. The flywheel 32 is mounted on a shaft 72 at an opposite end portion 74 of the bracket 66. A pair of bearings 76 and 78 (FIG. 3) are contained within that end portion 74 of the bracket 66. The bearings 76 and 78 support the shaft 72 and the flywheel 32 for rotation about an axis 79 parallel to the axis 51 of the output shaft 50 (FIG. 2).

A lower portion 80 of the compressor housing 64 defines an internal cylinder containing a piston 82. The piston 82 is supported for reciprocating movement along an axis 83 perpendicular to the axes 51 and 79. An upper portion 84 of the compressor housing 66 includes an air intake structure 86. Inlet and outlet valves (not shown) are located within the upper portion 84 of the housing 64. The valves operate to direct air through the housing 64 from the intake structure 86 to the outlet port 36 under the influence of the piston 82.

The piston 82 in the preferred embodiment is part of a linkage member 90 that is connected to the flywheel 32. A bearing 92 (FIG. 3) supports the linkage member 90 on a support member 94 that projects from the flywheel 32. The support member 94 in the preferred embodiment is a flat head screw. When the flywheel 32 rotates about the axis 79, the screw 94 moves along a circular path extending around the axis 79. This causes the linkage member 90 also to move around the axis 79, and simultaneously to move back and forth along the axis 83. The piston 82 then reciprocates along the axis 83, and thus pumps compressed air to the outlet port 36, upon rotation of the flywheel 32 under the influence of the output shaft 50 at the motor 28. A piston cap 93 and a fastener 96 together support a piston ring 98 on the piston 82.

Figure 3:
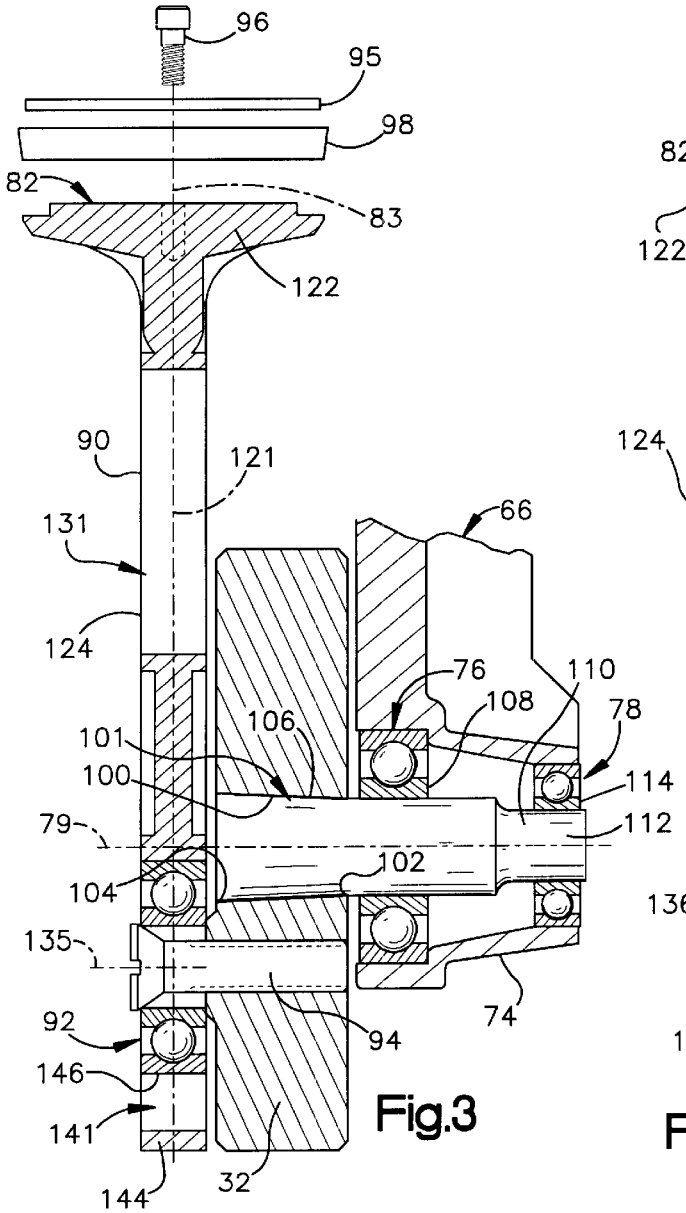
FIG. 3 is an enlarged sectional view, taken from above, including parts shown in FIG. 2.

More specific features of the compressor assembly 20 are shown in FIGS. 3–14. For example, as shown in FIG. 3, the flywheel 32 has an inner surface 100 defining a bore 101 in which the shaft 72 is received. The inner surface 100 is conical and is tapered uniformly along its length such that the inner end 102 of the bore 101 has a diameter that is slightly less than the diameter at the outer end 104. The shaft 72 is equally tapered at its outer surface 106, and is received within the bore 101 in an interference fit with the flywheel 32. The outer surface 106 of the shaft 72 is engaged in an interference fit with the inner race 108 at the first bearing 76 in the same manner. A reduced-diameter section 110 of the shaft 72 has a cylindrical outer surface 112 which is likewise engaged in an interference fit with the inner race 114 at the second bearing 78.

The shaft 72 is machined such that the outer surface 106 complies with close dimensional tolerances. However, the inner surface 100 of the flywheel 32 is not machined to close dimensional tolerances, but instead has the original configuration attained upon formation of the flywheel 32 as a cast metal part. The taper of the adjoining surfaces 100 and 106 enables the interference fit to be established without the need for precision machining at the inner surface 100. The manufacturing process is simplified, and a corresponding cost savings is achieved, by forming the torque-transmitting connection between the flywheel 32 and the shaft 72 in this manner.

Figure 4:
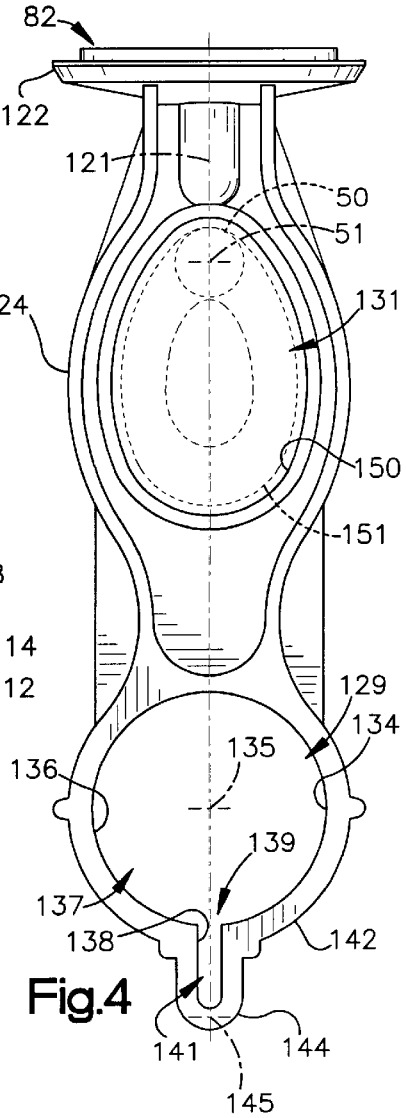
FIG. 4 is a side view of a part shown in FIG. 3.

The linkage member 90, which may also be referred to as a piston, is an elongated part with a longitudinal central axis 121 (FIGS. 3–4). An end portion 122 of the linkage member 90 is configured as a circular disk with a diameter generally perpendicular to the axis 121. That end portion 122 defines the piston 82 (FIG. 2), as noted above.

The bearing 92 at the other end of the linkage member 90 is mounted on the linkage member 90 in an interference fit. Specifically, the elongated body 124 of the linkage member 90 has a pair of openings 129 and 131 which are spaced-apart along its length. The first opening 129 comprises a pocket for the bearing 92, and is defined by an inner edge surface 134. The inner edge surface 134 extends continuously in a closed loop around an axis 135 which intersects the axis 121 orthogonally. A major section 136 of the inner edge surface 134 has an annular contour centered on the axis 135, and thus defines a circular portion 137 of the opening 129. A minor section 138 of the inner edge surface 134 has a U-shaped contour extending radially outward from a gap 139 in the major section 136, and thus defines a slot-shaped portion 141 of the opening 129. The peripheral edge surface 142 of the body 124 has a similar contour at a terminal end portion 144 of the body 124 that projects radially outward with the slot 141. The terminal end portion 144 of the body 124 is thus configured as a living hinge with a pivotal axis 145 parallel to the axis 135. The gap 139 can enlarge slightly upon flexure of the hinge 144 so that the bearing 92 can be installed in the circular portion 137 of the opening 129 with an interference fit between the cylindrical outer surface 146 of the bearing 92 and the annular inner surface 136 at the opening 129.

In accordance with a particular feature of the invention, the linkage member 90 is a cast metal part. When the linkage member 90 is being formed in a mold cavity, the configuration of the hinge portion 144 provides a path for the molten metal to flow circumferentially around the gap 139 at the annular section 136 of the inner edge surface 138. This enables the surface 138 to be formed precisely to specified tolerances because the molten metal can flow around the entire surface 138 without encountering any dead ends in the mold cavity. As a result, the annular section 136 of the surface 138 in the preferred embodiment is not machined, but instead has the original condition attained upon formation in the mold cavity. The time and expense of machining the surface 138 is thus avoided by the invention.

The output shaft 50 (FIG. 2) extends through the bracket 66 and the linkage member 90 as it projects axially from the motor 28 to the location of the second cooling fan 58. As shown schematically in FIG. 5, an opening 149 at the side of the bracket 66 provides clearance for the output shaft 50 to extend through the bracket 66. The second opening 131 (FIG. 4) in the body 124 of the linkage member 90 provides clearance for the output shaft 50 to extend through the linkage member 90. This enables the motor 28, the compressor housing 64 and the bracket to be installed over the platform 42 in an arrangement that is more compact than it would be if the output shaft 50 were located beside rather than within the bracket 66 and the linkage member 90. Preferably, as shown in FIG. 4, an inner edge surface 150 of the body 124 provides the opening 131 with an ovate periphery that closely surrounds the ovate path of movement 151 taken by the shaft 50 relative to the linkage member 90 upon oscillation of the linkage member 90 under the influence of the rotating flywheel 32. This helps to minimize the size of the linkage member 90 by minimizing the size of the opening 131.

A slot 161 (FIG. 2) in the base platform 42 also helps the compressor assembly 20 to be more compact. The slot 161 provides clearance for the flywheel 32 to project radially through the platform 42. The height of the flywheel 34 above the platform 42 is reduced accordingly.

An elastomeric pad 170 is adhered to the platform 42 directly beneath the motor 28. A clamping strap 172 extends over the motor 28, and is fastened to the platform 42 at its opposite ends so as to clamp the motor 28 firmly against the pad 170. In this arrangement, the pad 170 effectively isolates the platform 42 and the tank 12 from the vibration of the motor 28.

Figure 6:
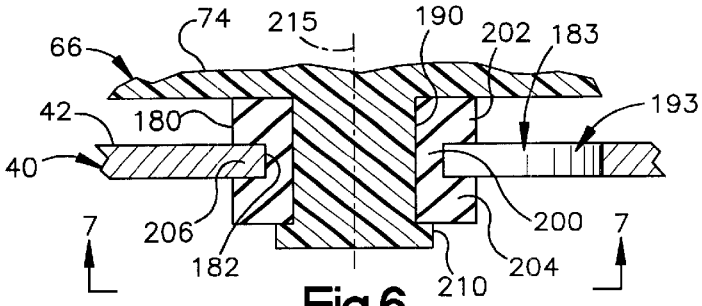
FIG. 6 is an enlarged sectional view of parts of the apparatus of FIG. 2.
Figure 7:
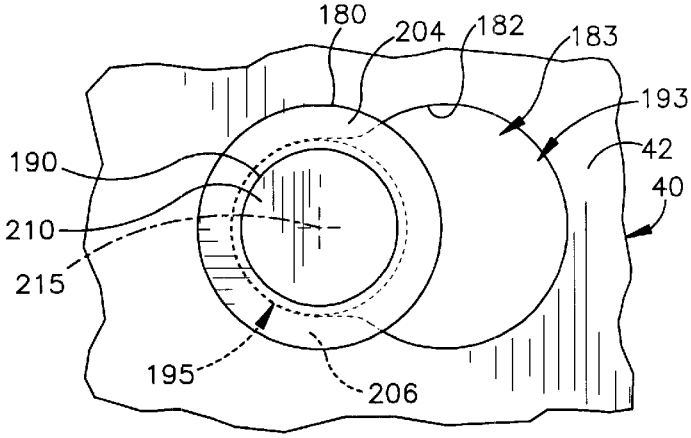
FIG. 7 is a view taken on line 7—7 of FIG. 6.

The compressor 30 also vibrates. However, a vibration damping structure 180 (FIGS. 6–7) is interposed between the bracket 66 and the platform 42 so as to isolate the base structure 40 and the tank 12 from the vibrations of the compressor 30. As shown in FIG. 2, an inner edge surface 182 of the platform 42 defines an opening 183 beneath the end portion 74 of the bracket 66 beside the flywheel 32. As shown in FIGS. 6–7, a cylindrical mounting boss 190 projects downward from the bracket 66 and extends through the opening 183. The damping structure 180 engages and supports the boss 190 within the opening 183.

More specifically, the mounting boss 190 and the bracket 66 are portions of a one-piece cast metal structure. By "one-piece" it is meant that the structure a single unit of homogeneous material and is free of separate but joined elements. The opening 183 in the platform 42 is keyhole-shaped with a major portion 193 and a minor portion 195. The damping structure 180 is a one-piece elastomeric part configured as a ring or grommet having a tubular central portion 200 and a pair of circular flanges 202 and 204 projecting radially from its opposite ends. The flanges 202 and 204 are preferably alike. Each flange 202 and 204 has a diameter that is less than the diameter of the major portion 193 of the opening 183 but greater than the diameter of the minor portion 195. Accordingly, when the ring 180 is received over the boss 190, the bracket 66 can be mounted on the platform 42 by moving the ring 180 and boss 190 longitudinally through the major portion 193 of the opening 183, and by subsequently moving them transversely to an installed position within the minor portion 195 of the opening 183. The adjacent edge portion 206 of the platform 42 is then received closely between the flangs 202 and 204 on the ring 180. The first flange 202 is firmly engaged axially between the bracket 66 and the platform 42. The second flange 204 is firmly engaged axially between the platform 42 and a flange 210 at the lower end of the boss 190. The ring 180 is thus engaged firmly between the bracket 66 and the platform 42 so as to isolate the base structure 40 from vibrations that could otherwise be transmitted through the bracket 66 from the compressor housing 64 and/or the rotating flywheel 32 to the platform 42.

Figure 5:
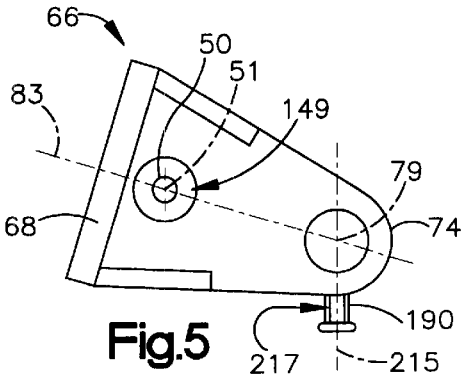
FIG. 5 is a schematic side view of another part shown in FIG. 2.

Preferably, the mounting boss 190 projects from the end portion 74 of the bracket 66 in an orientation in which the longitudinal central axis 215 of the mounting boss 190 intersects the flywheel axis 79 orthogonally, as shown schematically in FIG. 5. This helps to stabilize the rotating flywheel 32 relative to the platform 42. As further shown schematically in FIG. 5, an axially extending slot 217 reduces the thickness of the mounting boss 190. This promotes a consistent flow of molten metal material upon formation of the boss 190 in a mold cavity with the bracket 66.

Figure 8:
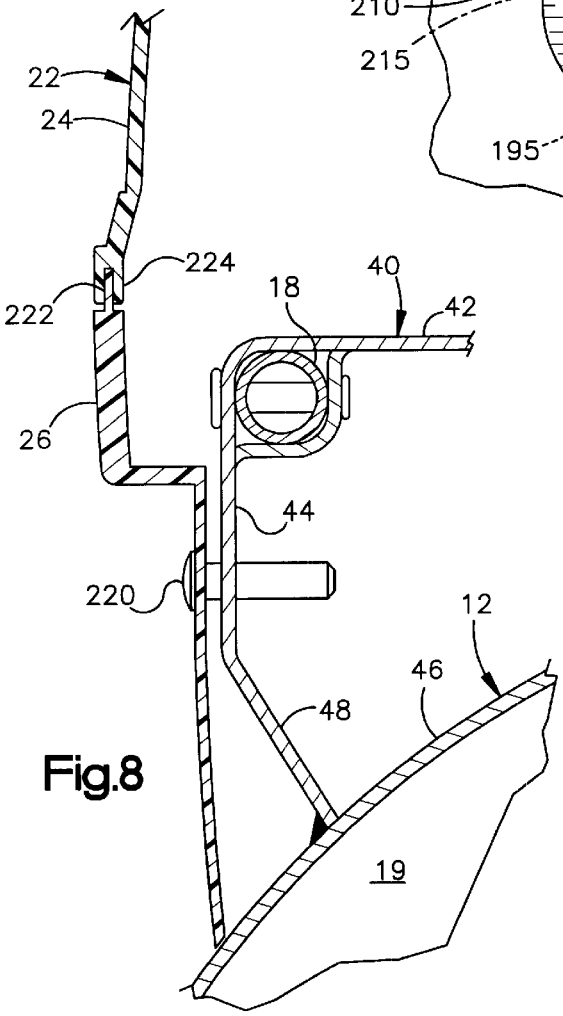
FIG. 8 is an enlarged sectional view of parts shown in FIGS. 1 and 2.

As noted above with reference to FIG. 1, the shroud 22 covers the parts of the compressor assembly 20 that are mounted on the platform 42. The lower section 26 of the shroud 22 is configured as a skirt that extends fully around the periphery of the compressor assembly 20. Fasteners 220 mount the lower section 26 on the base structure 40 adjacent to the four corners of the base structure 40. The handle bar 18 also is fastened to the base structure 40, as shown in FIG. 8. The upper section 24 of the shroud 22 is a removable cover that extends fully over the other parts of the compressor assembly 20. Four adjacent rim portions 222 of the lower section 26, one of which is shown in FIG. 8, engage corresponding rim portions 224 of the upper section 24 to locate the upper section 24 in its installed position. A solitary fastener 226 (FIG. 9) at the rear of the shroud 22 releasably secures the upper section 24 directly to the lower section 26. As compared with the fasteners 220 that secure the lower section 26 to the base structure 40, that fastener 226 is easily accessible from above the shroud 22. The upper and lower sections 24 and 26 of the shroud 22 may further be configured to snap together into interlocked engagement.

Figure 9:
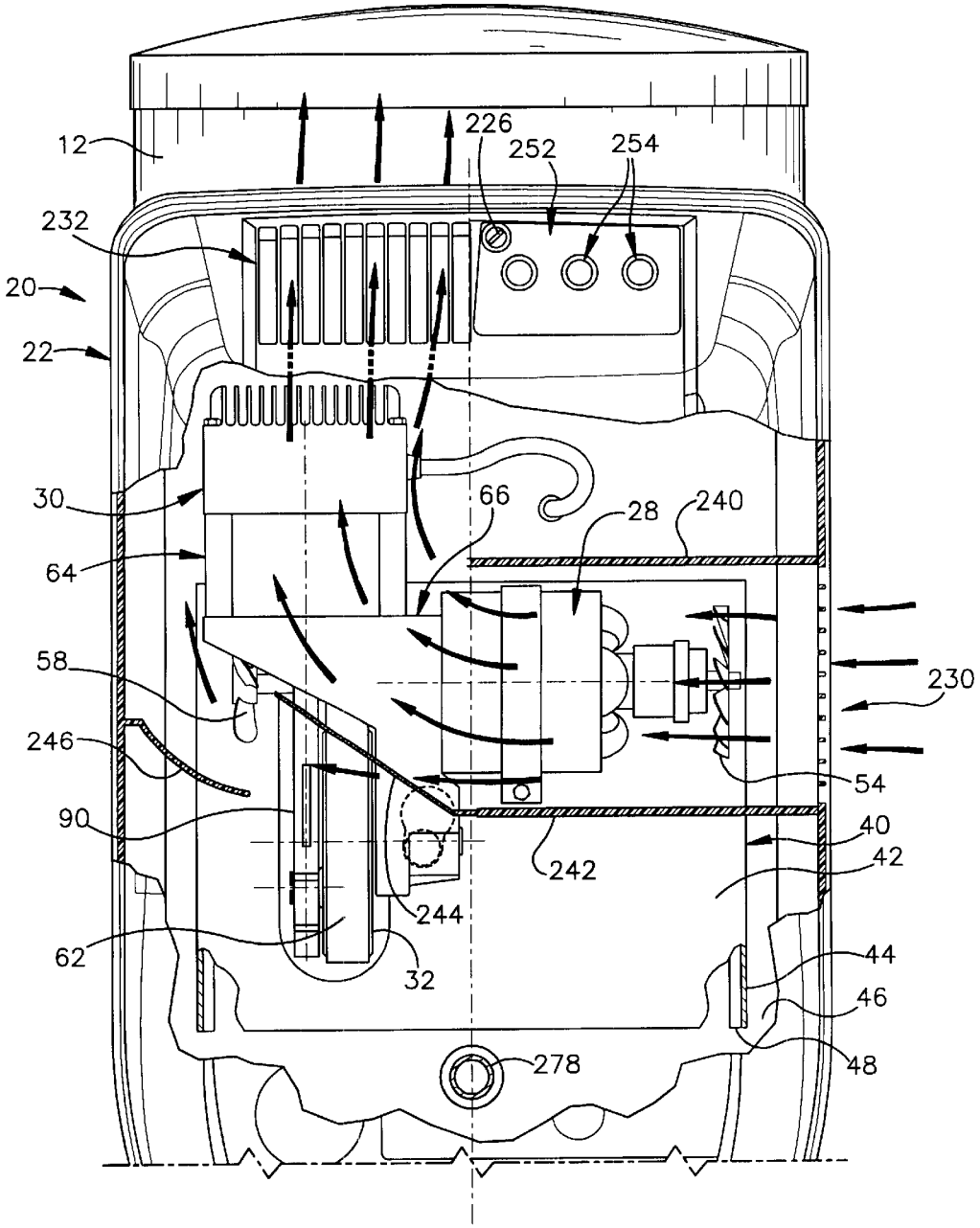
FIG. 9 is a partial view, taken from above, of parts shown in FIGS. 1 and 2.

The upper section 24 of the shroud 22 has an inlet grille 230 for receiving cooling air, and has an outlet grille 232 for exhausting cooling air. When the upper section 24 of the shroud 22 is installed over the lower section 26, as shown in FIG. 9, a plurality of internal wall portions of the upper section 24 direct cooling air to flow over the motor 28 and the compressor 30 upon flowing through the shroud 22 along a generally L-shaped flow path extending from the inlet grille 230 to the outlet grille 232. A mock grille 234 (FIG. 10) is located opposite the inlet grille 230 for symmetry of appearance.

The internal walls include a pair of parallel walls 240 and 242 on opposite sides of the motor 28. These walls extend vertically from the top of the upper section 24 nearly to the level of the base platform 42, and extend horizontally from the inlet grille 230 to the opposite end of the motor 28. Another internal wall 244 projects at an angle from the end of the wall 242. That wall 244 extends vertically downward from the top of the upper section 24 above the linkage member 90, the flywheel 32 and the adjacent end portion 74 of the bracket 66. An arcuate internal wall 246 projects from the opposite side of upper section 24. The arcuate wall 246 also extends from the top of the upper section 24 nearly to the base platform 42. Additionally, the first and second cooling fans 54 and 58 are both oriented to move air in the same direction extending from right to left along the axis 51, as viewed from above in FIG. 9, and thereby to drive the flow of air along the L-shaped flow path.

Figure 11:
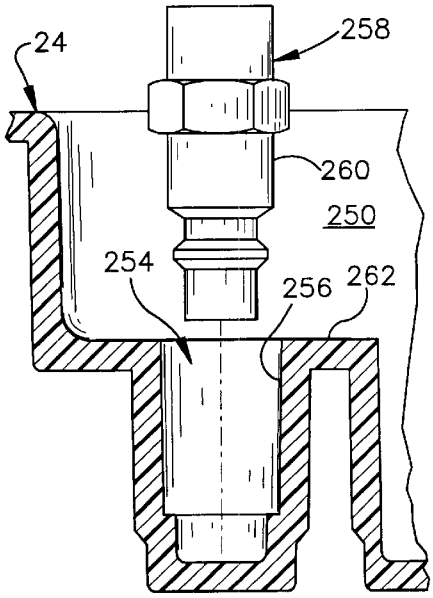
FIG. 11 is an enlarged view showing a portion of the part of FIG. 10 in relation to a connector tool used with the apparatus of FIG. 1.
Figure 10:
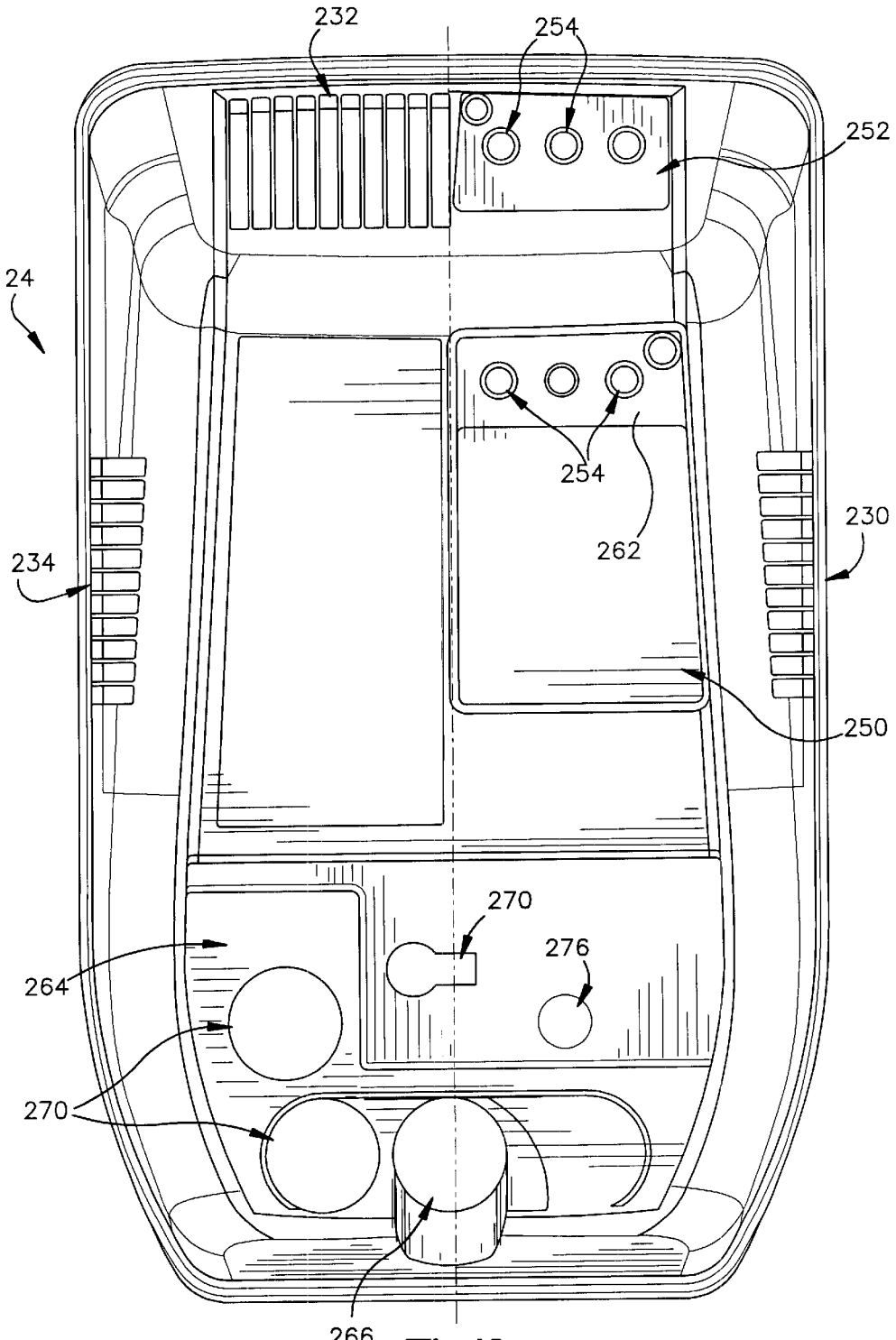
FIG. 10 is a top view of a part shown in FIGS. 1 and 9.

Other features of the upper section 24 are shown in the top view of FIG. 10. These include a pair of recesses 250 and 252 for holding tools. Cylindrical bores 254 in each recess 250 and 252 are configured to hold quick-connect fittings of various sizes. For example, as shown in FIG. 11, a bore 254 is defined by a cylindrical inner surface 256. The cylindrical inner surface 256 is slightly tapered radially inward. The cylindrical inner surface 256 is thus configured with reference to a corresponding-size fitting 258 so as to engage a cylindrical outer surface 260 of the fitting 258 in a manually releaseable interference fit. The sizes of the other bores 254 are likewise specified to correspond to the sizes of fittings that are used with the various pneumatically operated tools that can be powered by the apparatus 10.

As best shown in FIG. 1, the bores 254 in the upper recess 250 are arranged in a row along a shoulder structure 262 at a rear inner corner of the recess 250. This provides clearance for other tools to be stored at the top of the shroud 22.

A recessed forward region 264 of the upper section 24 also has a plurality of openings. These include an access opening 266 for an air pressure control knob 268 (FIG. 1), and a pair of access openings 270 for the faces of pressure gages 272 that are otherwise enclosed within the shroud 22. A smaller access opening 274 is configured for a key to reach an on-off switch (not shown) within the shroud 22. Another smaller access opening 276 is configured for a pressure relief valve stem 278 to project upward from the shroud 22. Those parts of the compressor assembly 20 can be operatively interconnected with the motor 28, the tank inlet 38, and the tank outlet 278 (FIG. 2) within the shroud 22 by the use of any suitable control system structure known in the art.

The invention has been described with reference to a preferred embodiment. Those skilled in the art will consider improvements, changes and modifications in view of the foregoing description. Such improvements, changes and modifications are intended to be within the scope of the claims.

What is claimed is:

1. An apparatus comprising:

a tank configured to contain air at an elevated pressure;

an air compressor operative to supply compressed air for storage in said tank;

a base structure configured to support said compressor on said tank, said base structure having an opening;

a mounting boss projecting from said compressor into said opening; and a vibration damping structure interposed between said mounting boss and said base structure within said opening.

2. An apparatus comprising:

a tank configured to contain air at an elevated pressure;

an air compressor operative to supply compressed air for storage in said tank;

a base structure configured to support said compressor on said tank, said base structure having an opening;

a mounting boss projecting from said compressor into said opening; and a vibration damping structure interposed between said mounting boss and said base structure within said opening;

said damping structure having a tubular central portion and first and second flange portions projecting radially from opposite ends of said central portion;

said opening having a major portion and a minor portion;

said boss having a longitudinal axis and a radially projecting flange, and being movable longitudinally into said major portion of said opening and transversely from said major portion to an installed position in said minor portion; and said damping structure being receivable over said boss and movable into said opening with said boss such that said tubular central portion of said damping structure extends axially through said opening, said first flange portion of said damping structure being engaged axially between said compressor and said base structure, and said second flange portion of said damping structure being engaged axially between said base structure and said flange on said boss when said boss is in said installed position.

3. An apparatus as defined in claim 2 wherein said damping structure comprises a one-piece elastomeric part including said tubular central portion and said first and second flange portions.

4. An apparatus as defined in claim 2 wherein said flange on said boss is circular with a first diameter, and said second flange portion of said damping structure is circular with a second, greater diameter.

5. An apparatus as defined in claim 4 wherein said major portion of said opening in said base structure has a third diameter greater than said second diameter.

6. An apparatus comprising:

a tank configured to contain air at an elevated pressure;

an air compressor operative to supply compressed air for storage in said tank;

a base structure configured to support said compressor on said tank, said base structure having an opening;

a mounting boss projecting from said compressor into said opening; and a vibration damping structure interposed between said mounting boss and said base structure within said opening;

said compressor including a housing defining a cylinder and a bracket projecting from said housing, with said mounting boss and said bracket being portions of a one-piece cast metal structure.

7. An apparatus comprising:

a tank configured to contain air at an elevated pressure;

an air compressor operative to supply compressed air for storage in said tank;

a base structure configured to support said compressor on said tank, said base structure having an opening;

a mounting boss projecting from said compressor into said opening;

a vibration damping structure interposed between said mounting boss and said base structure within said opening; and a flywheel supported for rotation about a flywheel axis, with said mounting boss being oriented relative to said flywheel such that a longitudinal central axis of said mounting boss intersects said flywheel axis orthogonally.

8. An apparatus as defined in claim 7 further comprising a motor having an output shaft operatively connected with said flywheel, and an additional vibration damping structure interposed between said motor and said base structure.

* * * * *